US005326327A

United States Patent [19]

Stephens et al.

[11] Patent Number: 5,326,327

[45] Date of Patent: Jul. 5, 1994

[54] SWING ASSEMBLY

[75] Inventors: William B. Stephens, Boulder; Joseph E. Janicke, Eldorado Springs; T. Brent Freese, Westminster, all of Colo.

[73] Assignee: Gerry Baby Products Company, Denver, Colo.

[21] Appl. No.: 942,202

[22] Filed: Sep. 8, 1992

[51] Int. Cl.[5] ..... A63G 9/16

[52] U.S. Cl. ..... 472/119; 472/118; 297/261

[58] Field of Search ..... 472/118, 119; 5/108, 5/109; 297/260, 271, 281, 273

[56] References Cited

U.S. PATENT DOCUMENTS

| | | | |
|---|---|---|---|
| D. 305,584 | 1/1990 | Spilman et al. | D6/344 |
| 727,741 | 5/1903 | Brott . | |
| 2,646,838 | 7/1953 | Welsh | 155/11 |
| 3,125,767 | 3/1964 | Griggs et al. | 5/109 |
| 3,414,325 | 12/1968 | Jutila | 297/281 |
| 3,648,307 | 3/1972 | Meade | 5/108 |
| 3,653,080 | 4/1972 | Hafele | 5/108 |
| 4,150,820 | 4/1979 | Bochmann | 272/86 |
| 4,211,401 | 7/1980 | Cunard | 272/86 |
| 4,240,625 | 12/1980 | Meeker | 272/86 |
| 4,323,233 | 4/1982 | Gebhard | 272/86 |
| 4,325,578 | 4/1982 | Borucki | 297/281 |
| 4,616,824 | 10/1986 | Quinlan, Jr. et al. | 272/86 |
| 4,688,850 | 8/1987 | Brownlie et al. | 297/270 |
| 4,744,599 | 5/1988 | Jankowski et al. | 297/250 |
| 4,805,902 | 2/1989 | Casagrande | 272/86 |
| 4,807,872 | 2/1989 | Spilman et al. | 272/86 |
| 4,822,033 | 4/1989 | Kohus et al. | 297/273 |
| 4,911,499 | 3/1990 | Meeker | 297/260 |
| 5,139,462 | 8/1992 | Gabe | 5/109 |

*Primary Examiner*—Carl D. Friedman
*Assistant Examiner*—Kien Nguyen
*Attorney, Agent, or Firm*—Biebel & French

[57] ABSTRACT

A swing assembly is provided in which low profile side members are used to support a seat member for gliding back and forth movement. The seat member may be rotated between sitting and inclined positions and includes a movable T-bar which is adapted to be pivoted forwardly in order to facilitate movement of an infant into and out of the seat.

28 Claims, 7 Drawing Sheets

SWING ASSEMBLY

BACKGROUND OF THE INVENTION

The present invention relates to a swing assembly and, more particularly, to a swing assembly which has a compact configuration and which provides easy access for placing an infant in the assembly.

Children's swings for infants have been available for several years and typically include an overhead support housing for supporting a pair of pivoting side bars which support an infant seat. The overhead housing is typically supported by two front legs and two rear legs and, as a result, the infant seat is commonly pivoted about a pivot point located a substantial distance from the seat such that the arc of pivot for the seat is also large and the infant will undergo a minimal amount of angular tilting while swinging.

Further, as a result of providing an overhead structure for supporting the seat during its swinging movement, access to the seat from above the seat is hindered and it is sometimes difficult to place the infant within the seat. This is particularly true when the seat is provided with a stationary front strap or bar for engaging between the infant's legs and retaining the infant in the seat, which thus requires that the infant's legs be threaded through a pair of openings in the seat while the infant is lowered into the seat. In addition, as a result of the support legs extending up adjacent to the location of the pivot point in the overhead housing, the legs are typically extremely long and make it difficult to maneuver the swing when it is transported between different rooms in a house.

U.S. Pat. No. 4,807,872 to Spillman et al discloses a device which attempts to overcome the problem associated with inadequate overhead access room for the infant seat and includes side members which extend upwardly a sufficient distance to support a pivot for the seat while providing an open central area above the seat. However, this device still requires the provision of a pivot point for the seat which is substantially above the seat in order to provide a desired swing arc such that this device suffers from the disadvantage of being relatively awkward to maneuver when being transported to different locations.

Accordingly, there is a need for a swing assembly having improved access for permitting an infant to be easily placed in a seat of the assembly, and which is formed of a compact structure whereby the assembly may be easily transported to different locations.

SUMMARY OF THE INVENTION

In one aspect, the present invention provides a swing assembly including a housing; a first support mounted to the housing for pivotal movement relative to the housing; a second support mounted to the first support, wherein the first and second supports are pivotable relative to each other; a seat mounted to the second support and defining means for receiving a person therein; and wherein the first and second supports cooperate to support the seat for gliding movement relative to the housing.

The first support preferably includes front and rear U-shaped swing members pivotally mounted to the housing. The second support includes first and second side members, each of the side members including front and rear engaging means for engaging the front and rear swing members, respectively. Further, the first and second side members extend upwardly into engagement with opposing side walls of the seat.

In a further aspect of the invention, the seat is mounted for pivotal movement relative to the second support whereby the seat may be oriented to one of two predetermined angular positions relative to the second support.

In another aspect of the invention, a tray is provided including a horizontal tray member for extending between opposing sides of the seat member and a post member rigidly attached to a central portion of the tray member. The post member cooperates with a slot formed in the seat whereby the tray may be moved in a vertical direction. At an upper portion of the vertical travel of the tray, the tray is pivotable relative to the seat whereby the tray may be moved forwardly to provide improved access for an infant to be placed in the seat.

Therefore, it is an object of the invention to provide a swing assembly wherein the seat is provided with a gilding motion whereby variations in the angular orientation of the seat are minimized.

It is another object of the invention to provide a swing assembly having a gliding motion wherein the angular orientation of the seat may be altered between preselected positions.

It is yet another object of the invention to provide a swing assembly having a seat which includes a tray and restraining element for restraining an infant within the seat and which may be pivoted away from the seat back to permit improved access to the seat.

Other objects and advantages of the invention will be apparent from the following description, the accompanying drawings, and the appended claims.

DETAILED DESCRIPTION OF THE PREFERRED EMBODIMENT

Figure 1:
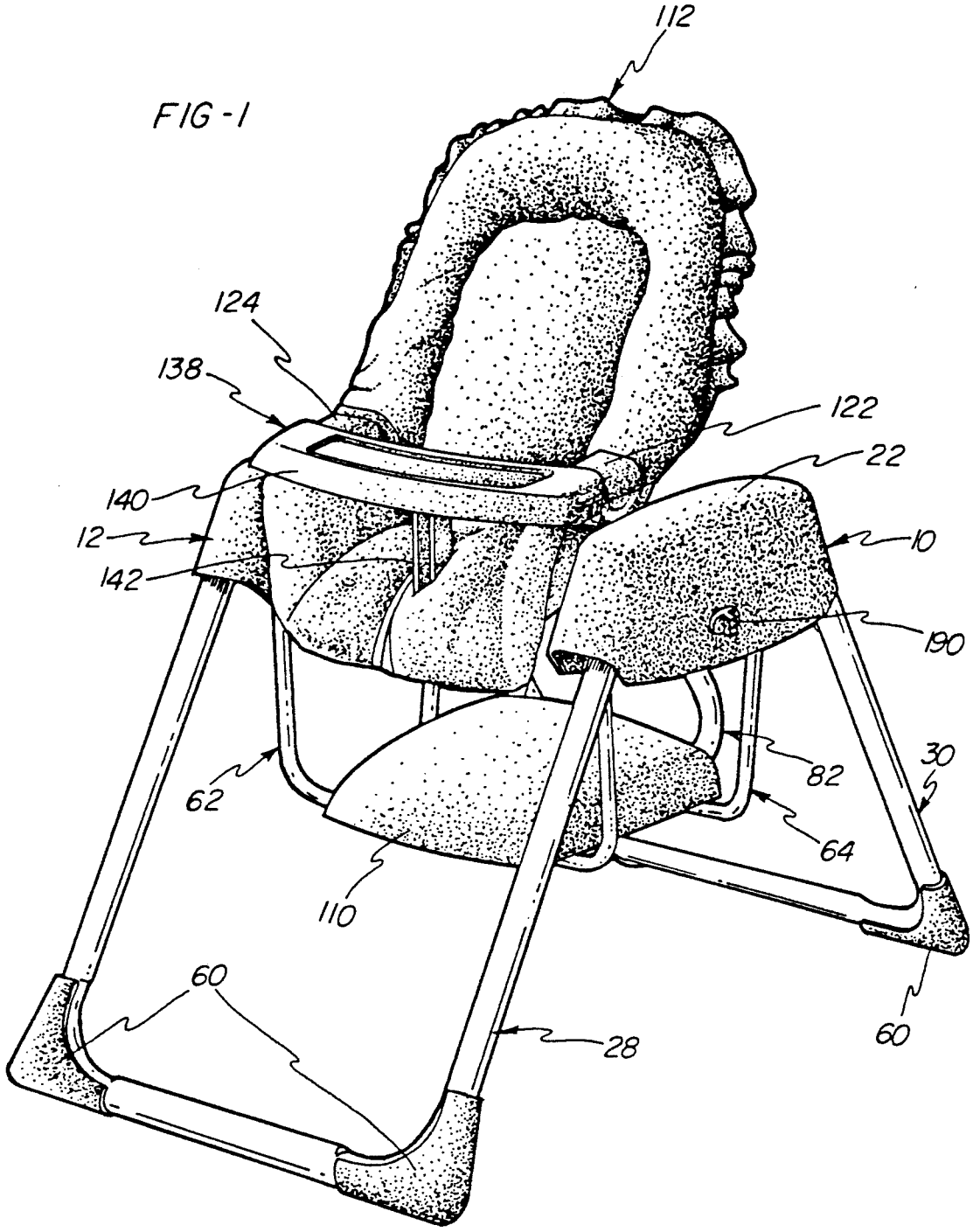
FIG. 1 is a perspective view of the swing of the present invention.
Figure 2:
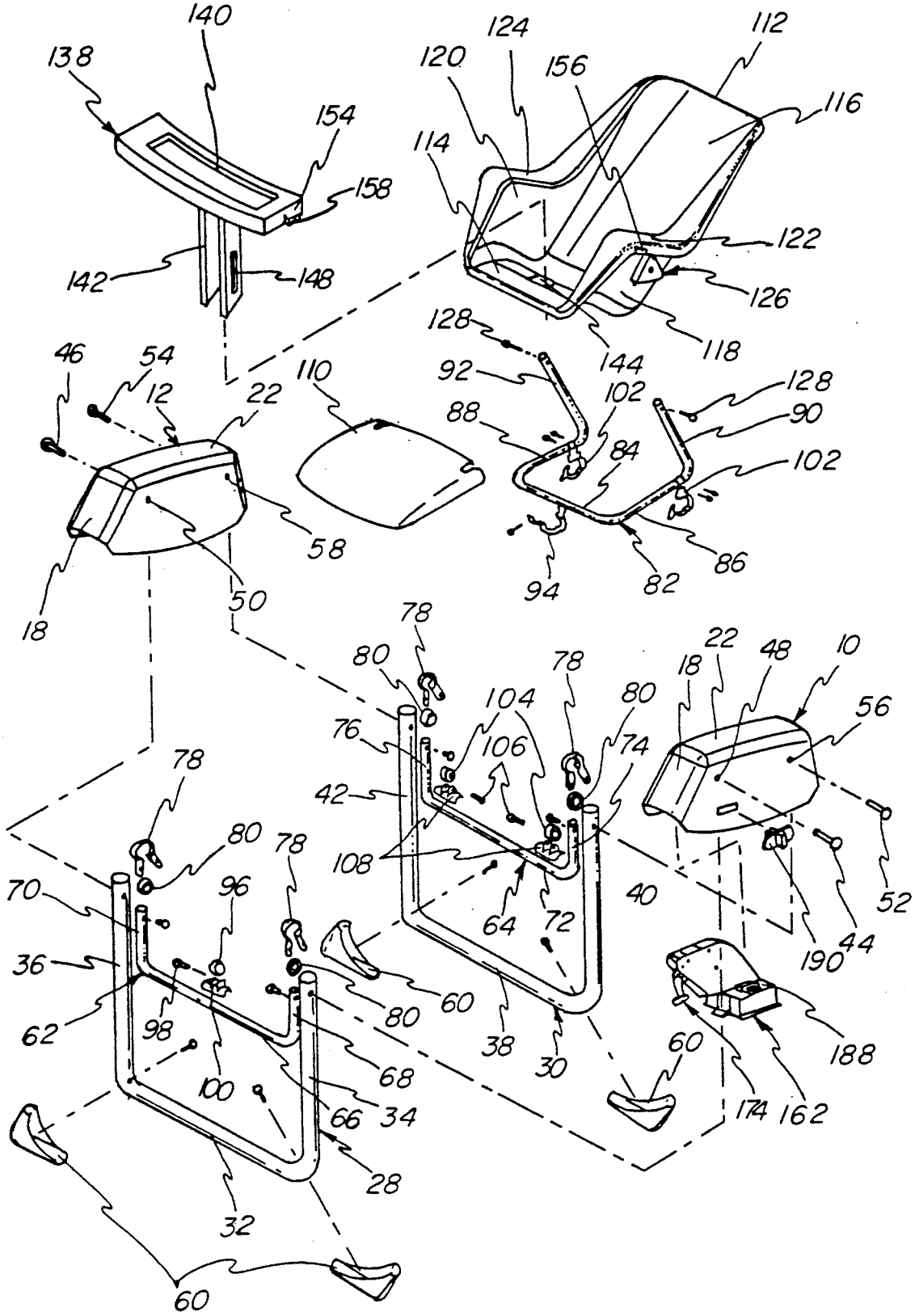
FIG. 2 is an exploded view of the present invention.
Figure 3:
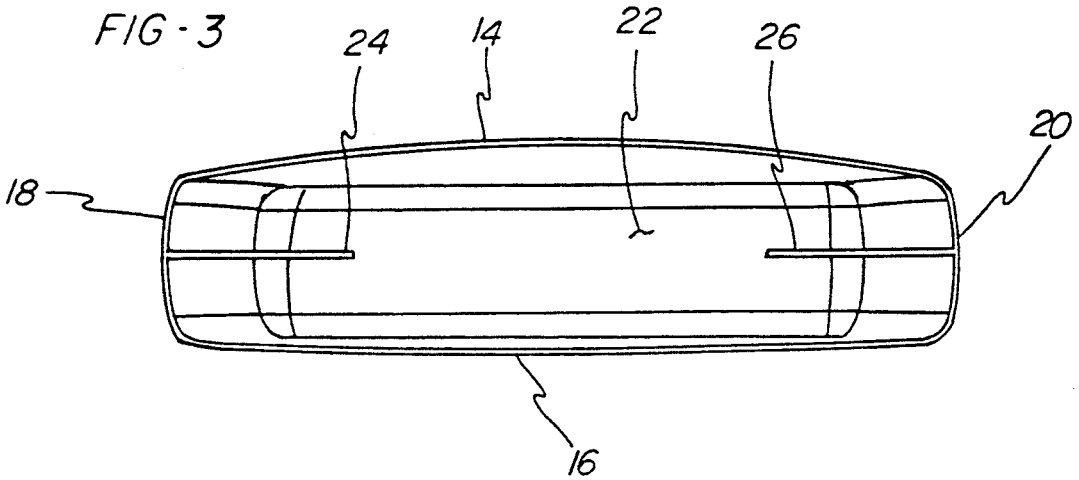
FIG. 3 is a bottom plan view of a side housing member.

Referring to FIGS. 1 and 2, the swing assembly of the present invention includes first and second side housing members 10, 12 forming side support frames for the swing. The housing members 10, 12 are formed as substantially identical elements and will be described with reference to housing 10 wherein similar elements on the housing 12 are identified with the same reference numeral. As is shown in FIG. 3, the housing 10 includes opposing lateral walls 14, 16 connected by front and rear end walls 18, 20 and a top wall 22. In addition, front and rear ribs 24, 26 extend from respective end walls 18, 20 in a longitudinal direction 20 to form dividers between the lateral walls 14, 16 adjacent to the ends 18, 20.

Referring to FIGS. 1 and 2, front and rear U-shaped leg members 28, 30 are provided for supporting the side housing members 10, 12 in spaced relationship to a floor surface. The front leg member includes a horizontal portion 32 and upwardly extending vertical portions 34, 36. Similarly, the rear leg member 30 includes a horizontal portion 38 and upwardly extending vertical portions 40, 42. The vertical portions 34, 36 of the front leg member 28 are attached to the front portion of the side housing members 10, 12 by pins 44, 46 which extend through front apertures 48, 50 and between the lateral walls 14, 16. The vertical portions 40, 42 of the rear leg member 30 are attached to a rear portion of the side housing members 10, 12 by pins 52, 54 which extend through apertures 56, 58, respectively. Thus, the front and rear leg members 28, 30 are mounted for pivotal movement relative to the housing members 10, 12 and in their open position, will rest against the front and rear end walls 18, 20. Further, it should be noted that the vertical leg portions 34, 36, 40, 42 are located between a respective rib member 24, 26 and a laterally outer wall of the side housing members 10, 12.

It should also be noted that corner foot members 60 are provided at the junction between the horizontal portions 32, 38 and the respective vertical portions 36, 34, 40, 42 to provide added stability to the assembly.

Front and rear swing arms 62, 64 are mounted to the swing assembly adjacent to respective front and rear leg members 28, 30. The front swing arm 62 includes a horizontal portion 66 and upwardly extending vertical portions 68, 70. Similarly, the rear swing arm 64 includes a horizontal portion 72 and upwardly extending vertical portions 74, 76 wherein the front vertical portions 68, 70 are substantially the same length as the rear vertical portions 74, 76.

The upper end of each of the vertical portions 68, 70, 74, 76 are attached to a bearing fitting 78 by means of a fastener passing through an aperture formed in the upper ends of the vertical portions 68, 70, 74, 76. The bearing fittings 78 clamp around the outer race of bearings 80, which may be in the form of ball bearings, to attach the bearings 80 to the swing arms 62, 64. In addition, the pins 44, 46, 52, 54 for engaging the leg members 28, 30 pass through the inner race of the bearings 80 whereby the swing arms 62, 64 are mounted for pivotal movement on the bearings 80 about common pivot axes with the leg members 28, 30.

A seat support tube 82 is located above the swing arms 62, 64 and includes a U-shaped horizontal portion defined by a laterally extending portion 84 and rearwardly 10 extending longitudinal portions 86, 88. In addition, upwardly and forwardly extending vertical portions 90, 92 are formed as extensions of the longitudinal portions 86, 88, respectively. The lateral portion 84 carries a bearing fitting 94 for extending around the outer race of a front bearing 96, and a pin 98 extends through the inner race of the bearing 96 to engage upwardly extending lugs on a front bearing support 100 which is attached to the front swing arm 62. Similarly, a pair of rear bearing fittings 102 are attached to the longitudinal portions 86, 88 for engaging the outer race of rear bearings 104 which are mounted by pins 106 to rear bearing mounts 108 attached to the rear swing arm 64.

Thus, the swing arms 62, 64 are mounted for pivotal movement relative to the seat support tube 82, and the seat support tube 82 in combination with the swing arms 62, 64 form a glide structure such that any change of the orientation of the longitudinal portions 86, 88 from the horizontal is minimized during swinging movement of the swing arms 62, 64. Further, it should be noted that a cover 110 may be provided for covering the horizontal portion of the seat support tube 82 as well as the horizontal portion of the swing arms 62, 64 whereby the bearings 96, 104 are hidden from view.

Figure 4:
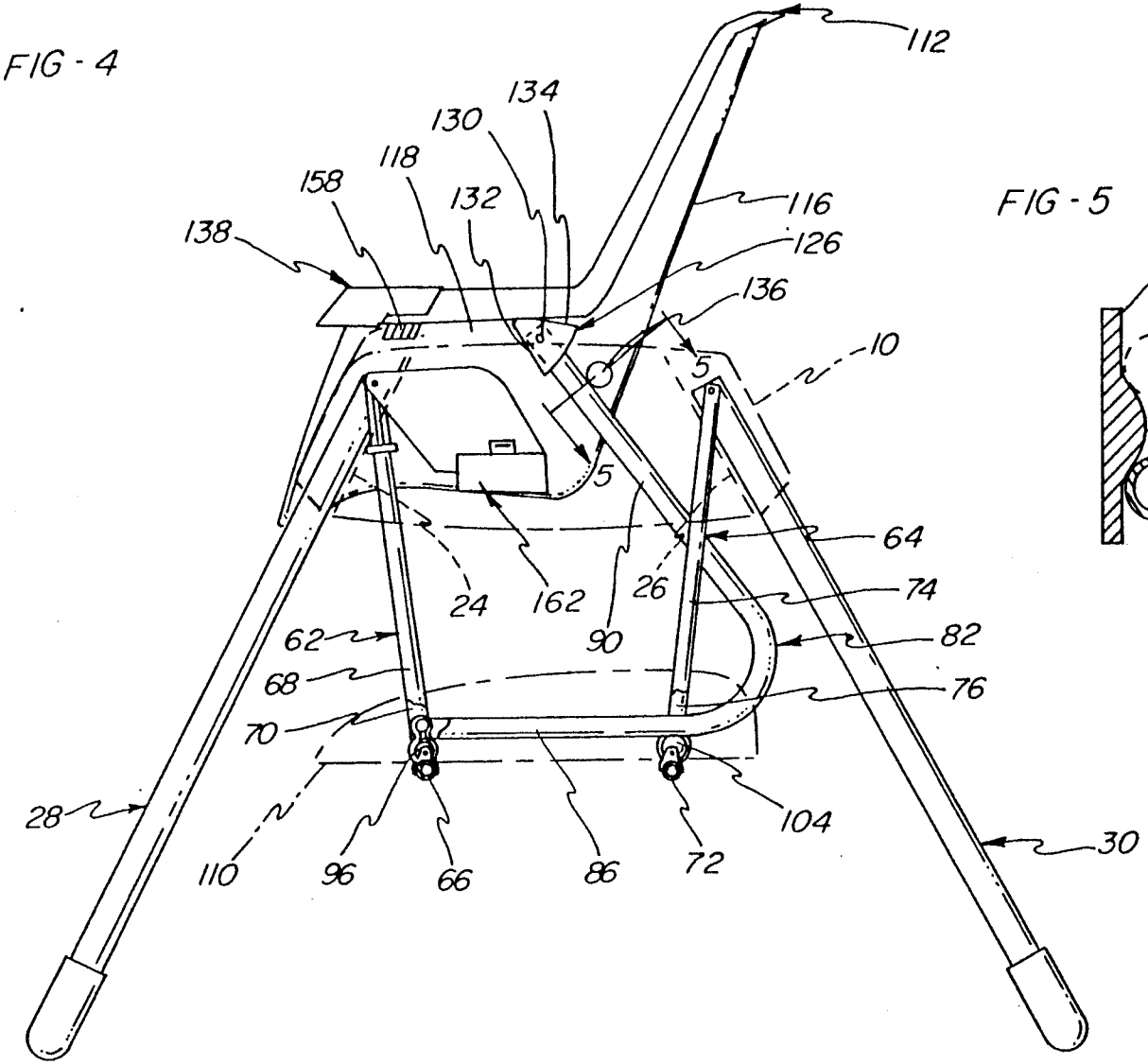
FIG. 4 is an elevational view of the swing with a side housing member shown in phantom and a lower section of the vertical swing arm portions on one side of the swing cut away to show the bearing connection between the swing arms and the seat support tube.

A seat member 112 is mounted to the upper ends of the support tube vertical portions 90, 92. The seat member 112 includes a support portion defined by a substantially horizontal seat member 114 and a substantially vertical back portion 116. Laterally opposed first and second side portions 118,120 extend along the seat and back portions 114, 116 and include laterally outwardly extending upper edges 122, 124 positioned above the upper walls 22 of the side housing members 10, 12. Referring further to FIG. 4, a pivot housing 126 is provided on each side 118, 120 of the seat member 112 and includes an opening in a lower portion thereof for receiving an upper end of the vertical support tube portions 90, 92. Pins 128 are provided for passing through the upper ends of the support tube portions 90, 92 and through an aperture 130 in the pivot housing 126 whereby the seat member 112 is mounted for pivotal movement relative to the seat support tube 82.

Figure 5:
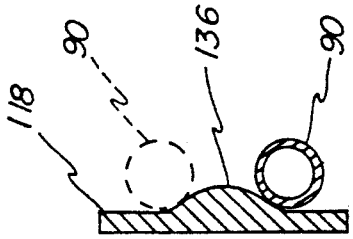
FIG. 5 is a cross-sectional view taken along line 5—5 in FIG. 4.

The pivot housing 126 includes side walls 132, 134 which define first and second stop surfaces located about the seat pivot 130 and which are angularly spaced from each other to define two stop positions for limiting the pivotal movement of the seat member 112. Thus, the wall 132 defines a sitting position for the seat member 112 and the wall 134 defines a reclining position for the seat member 112. In addition, a raised bump 136 is located on each of the sides 118, 120 and extends laterally therefrom to engage the vertical support tube portions 90, 92. As may be seen in FIG. 5, the bump 136 acts as a detent whereby the seat is biased into either the sitting or reclining position until sufficient force is applied to the seat to pivot it against the frictional force applied by the bump 136 to another position. In other words, the bump 136 acts as a ramp member to bias the vertical support tube portions 90, 92 into contact with either the wall 132 or the wall 134.

A tray means 138 is located at a front portion of the seat member 112 and includes a horizontal tray member 140 and a vertical post member 142 rigidly attached to a lower portion of the tray member 140. The post member 142 is centrally located between opposing lateral sides of the tray member 138 such that the tray means 138 is configured as a generally T-shaped member. In addition, the post member 142 is adapted to extend into a slot 144 formed in the seat portion 114, and the slot 144 is defined by four peripheral walls which are located closely adjacent to the side walls defining the post member 142.

Figure 6:
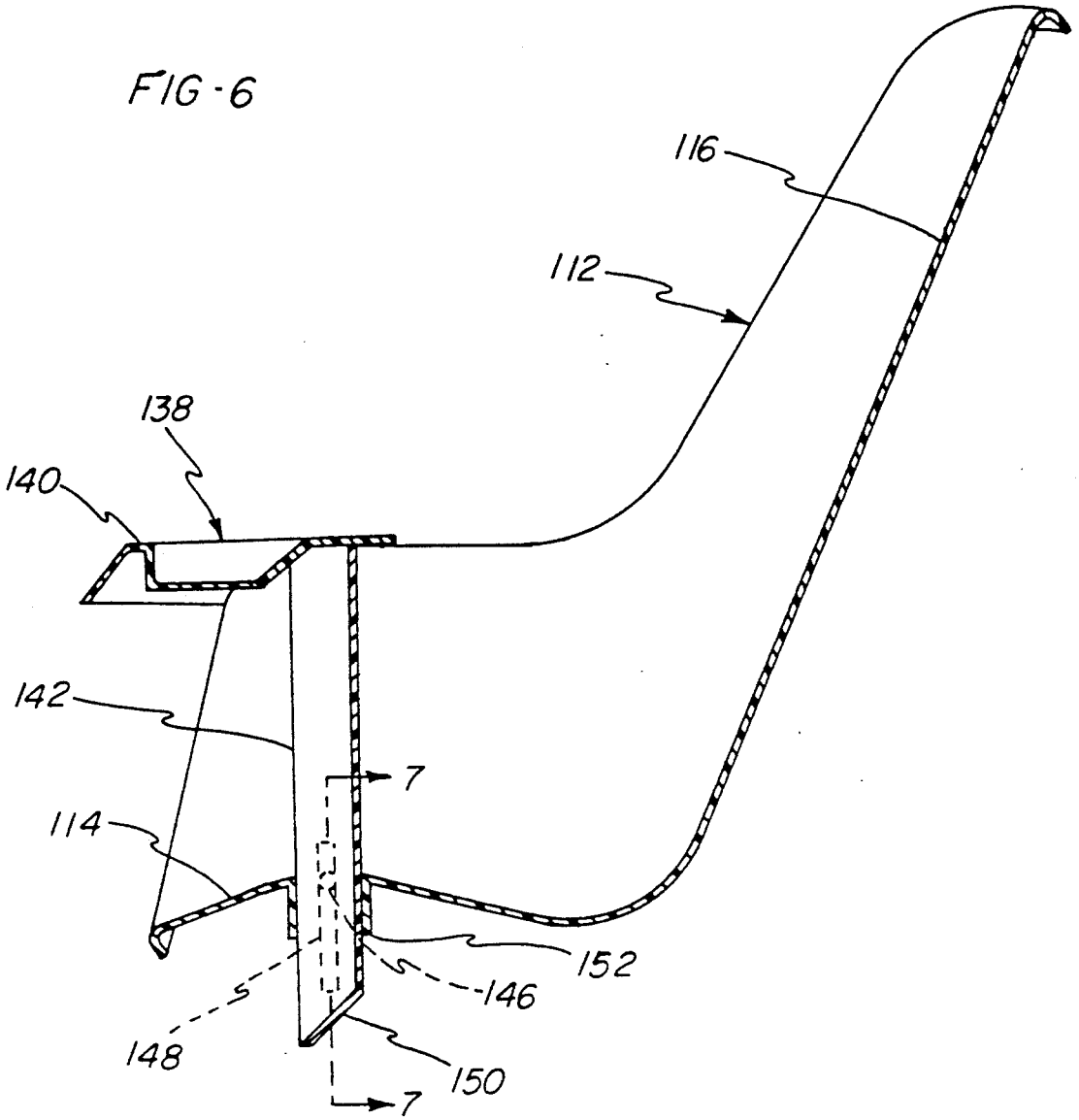
FIG. 6 is an elevational cross-sectional view taken through the center of the swing seat and showing the tray means in its first position.
Figure 7:
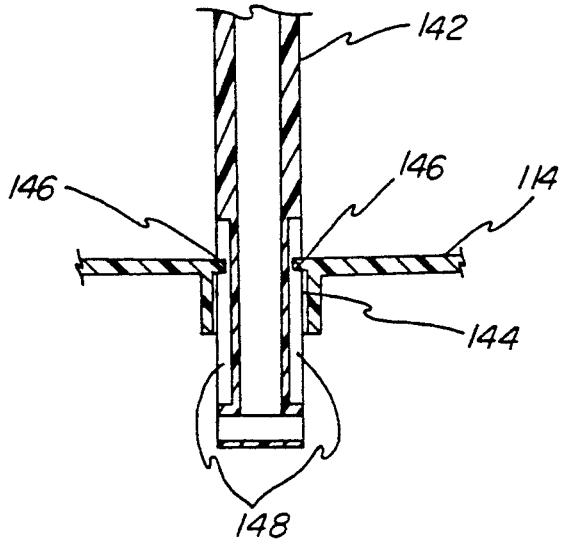
FIG. 7 is a cross-sectional view taken along line 7—7 in FIG. 6.
Figure 8:
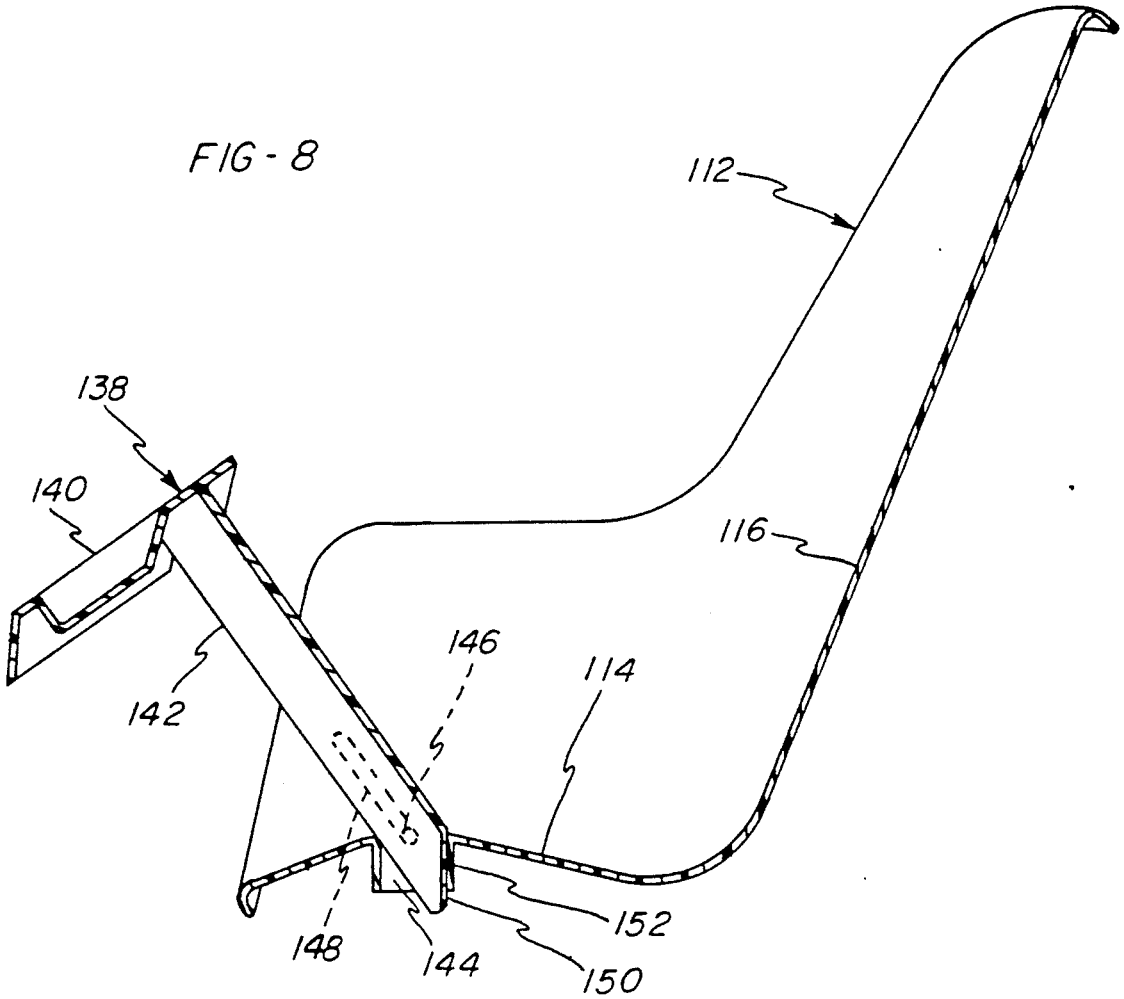
FIG. 8 is an elevational cross-sectional view similar to FIG. 6 in which the tray means is in its second position.

As may be seen in FIGS. 6–8, a pair of pins 146 extend inwardly into the slot from opposing lateral sides for engaging within vertical grooves 148 formed in opposing sides of the post member 142. The pins 146 and grooves 148 cooperate to guide the tray means 138 to first and second operable positions wherein the first operable position is defined by the pins 146 being positioned in an upper location of the slots 148 and with lateral edges of the tray member 140 in engagement with the upper seat edges 122, 124, as seen in FIG. 6. The second position of the tray means 138 is defined by the post member 142 being pulled upwardly through the slot such that pins 146 are associated with a lower portion of the grooves 148. A lower surface 150 of the post member 142 is tapered upwardly in a rearward direction such when the tray means 138 is in its second position, clearance is provided between the lower surface 150 and a rear wall 152 of the slot to permit forward pivoting of the tray means 138 in order to facilitate movement of an infant into and out of the seat member 112. Further, the lower surface 150 of the post member 142 engages the rear wall 152 when the tray means 138 has pivoted forward a predetermined amount, as shown in FIG. 8, in order to ensure that the tray means 138 will not pivot down to a level where a child could use it as a step to climb on.

Figure 9:
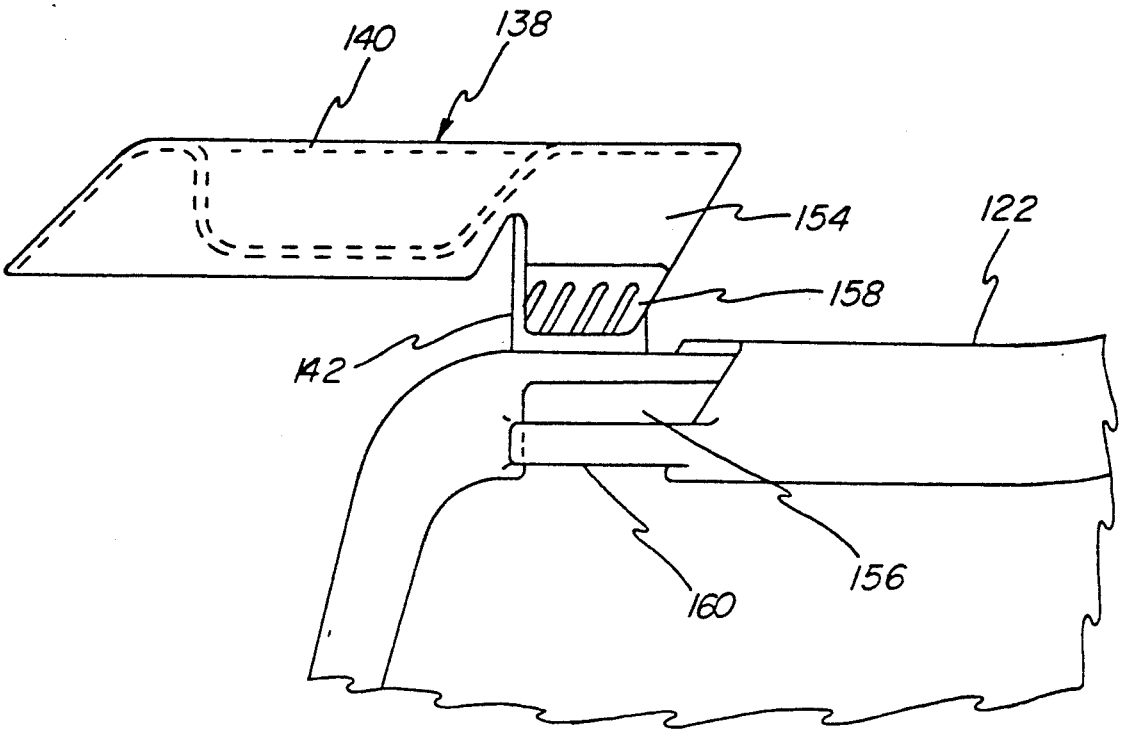
FIG. 9 is a side elevational view showing the tray means and the front upper edge of the seat just prior to the tray means moving into a locked position.
Figure 10:
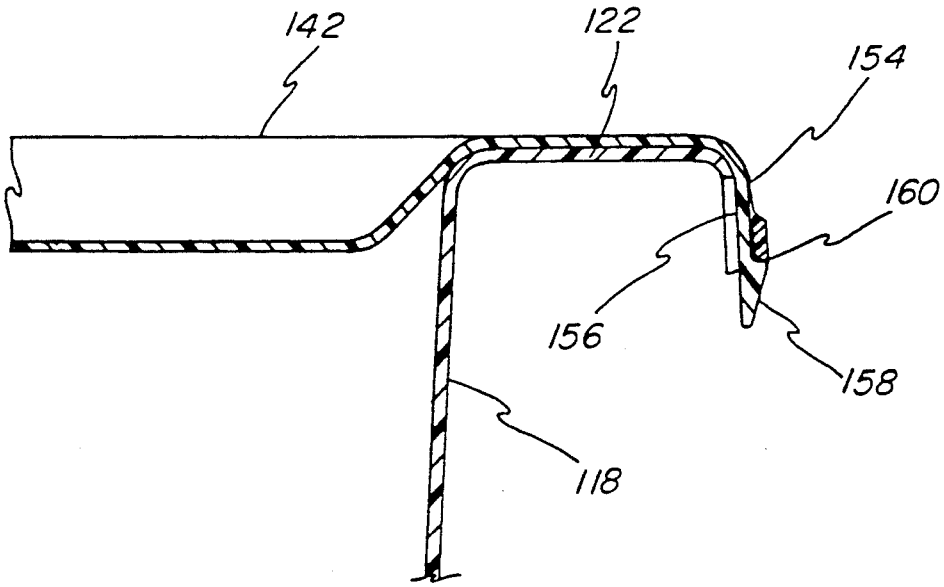
FIG. 10 is a front elevational cross-sectional view showing one side of the tray means in a locked position.

In order to lock the tray means 138 in its first position, the tray member 140 is provided with a locking tab 154 on each lateral side thereof for insertion into slots 156 defined in the laterally outer sides of the upper edges 122, 124, as shown in FIGS. 9 and 10. Each tab 154 is provided with a tang member 158 for engaging with a lower surface 160 of the edges 122, 124. In order to release the tabs 154 from engagement within the slots 156, the tang members 158 must be pressed inwardly while lifting up on the tray 138 and thereafter the tabs 154 will slip out of the slots 156 to permit movement of the tray means 138 to its second position.

A drive mechanism 162 is mounted within a forward portion of the housing 10 for driving the swing arm 62 in a back and forth swinging movement whereby the assembly defined by the swing arms 62, 64 and the seat support tube 82 is caused to move in a continuous back and forth gliding motion.

Figure 12:
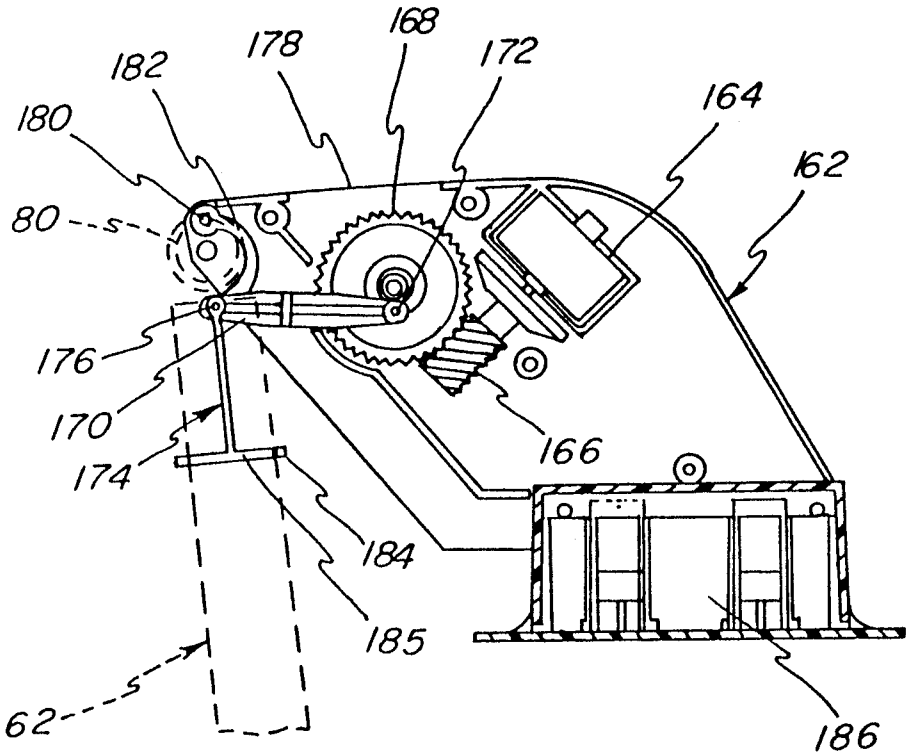
FIG. 12 is a cross-sectional view of the drive mechanism taken along line 12—12 in FIG. 11.
Figure 11:
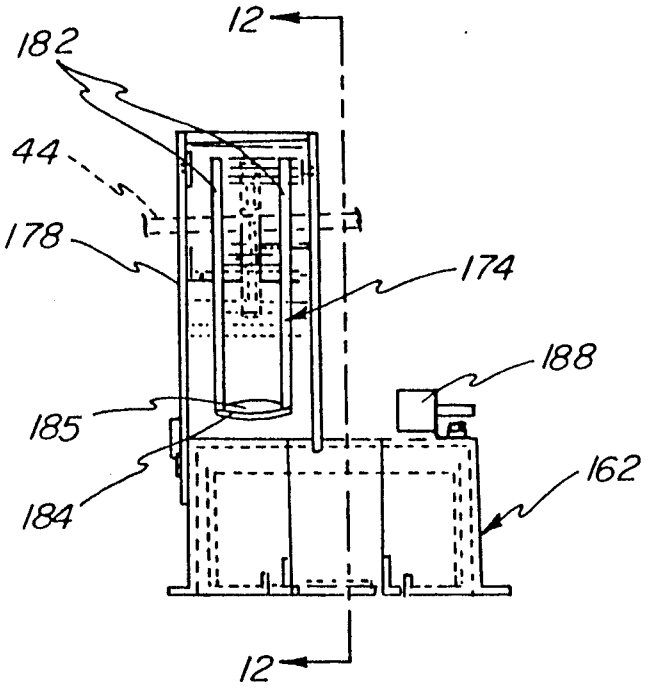
FIG. 11 is a front elevational view of the drive mechanism.

Referring to FIGS. 11 and 12, the drive mechanism 162 includes a motor 164 rotatably driving conventional worm gears 166 and 168. As the gear 168 rotates, it drives a connecting rod 170 in reciprocating motion. One end of the connecting rod 170 is mounted eccentrically to the gear 168 at pivot point 172 and the opposite end of the connecting rod 170 is connected to an actuator 174 at a pivot point 176. In addition, an upper end of the actuator 174 is connected to a housing 178 for the driving mechanism at an upper pivot point 180 via a flexible connecting portion 182. A lower foot 184 of the actuator 174 defines an aperture 185 for receiving and forming a direct connection with the vertical portion 68 of the swing arm 62 whereby reciprocating movement of the connecting rod 170 will cause the swing arm 62 to pivot back and forth. In addition, if the seat member 112 and therefore the swing arm 62 is caused to be moved manually without actuation of the motor 164, the flexible portion 182 will permit the swing arm 62 and actuator 174 to pivot about the pivot point 176 to avoid the danger of breaking the components forming the driving portion of the drive mechanism 162.

A battery compartment 186 is located in a lower portion of the housing 178 for containing batteries, and a switch 188 is provided on top of the housing connected to an exterior actuator 190 located on the laterally outer side of the side member housing 10 whereby the motor 164 may be turned on and off.

From the above description of the invention, it should be apparent that the present swing provides an assembly having low profile support members such that the seat portion of the swing extends above the upper surfaces of the support whereby an infant may be easily placed into the swing from locations along the side of the assembly.

Further, by providing a glide movement for the seat assembly, sufficient swinging movement for the infant is provided without requiring a long pivot arm from the pivot point for the arm to the seat in order to avoid large angular changes in the orientation of the seat as it is moved between its extreme positions.

Another advantage of the present invention lies in retaining the above-described low profile and gliding features while also incorporating a pivoting mechanism whereby the seat may be pivoted between the sitting and reclined position.

Yet another advantage of the present invention results from providing a pivoting T-bar tray assembly for retaining an infant in the seat and which may be pivoted to a forward position to facilitate movement of an infant into and out of the seat.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A swing assembly comprising:

first and second side housing members;

first support means including a front swing member and a rear swing member mounted to said housing means for pivotal movement relative to said housing members, wherein said front swing member extends between front portions of said first and second side housing members, and said rear swing member extends between rear portions of said first and second side housing members in spaced relation to said front swing member;

second support means mounted to said first support means for movement relative to said first and second side members, wherein said first and second support means are pivotable relative to each other;

a seat member mounted to said second support means and defining means for receiving a person therein; and wherein said first and second support means cooperate to support said seat member for gliding movement relative to said housing members.

2. The swing assembly of claim 1 wherein said seat member is mounted for pivotal movement relative to said second support means.

3. The swing assembly of claim 1 wherein said second support means includes first and second side members, each said second support means side member including front and rear engaging means for engaging said front and rear swing members, respectively, and said first and second support means side members extending upwardly into engagement with opposing side walls of said seat member.

4. The swing assembly of claim 3 wherein said front and rear engaging means include front and rear bearing means forming front and rear pivot connections between said second support means and said front and rear swing members, respectively.

5. The swing assembly o claim 1 including front and rear leg members mounted to and extending downwardly from said housing members for supporting said swing assembly on a floor surface.

6. The swing assembly of claim 5 wherein said front and rear swing members are mounted for movement about first and second swing axes, and said front and rear leg members are mounted for pivotal movement about said first and second axes, respectively.

7. The swing assembly of claim 1 including tray means comprising a horizontal tray member for extending between opposing sides of said seat member and a post member rigidly attached to a central portion of said tray member, said seat member and said post member including cooperating means for supporting said tray means for pivotal movement relative to said seat member in a front to rear direction.

8. The swing assembly of claim 7 wherein said seat member includes an aperture for receiving said post member in slidable vertical movement relative to said seat member, said post member being movable in linear movement between a first position with said tray member engaged with opposing sides of said seat member and a second position with said tray member elevated out of contact with said seat member and disposed for said pivotal movement relative to said seat member.

9. The swing assembly of claim 1 wherein said front swing member includes a pair of front vertical members mounted to said side housing members for movement about a front pivot axis, and said rear swing member includes a pair of rear vertical members mounted to said side housing members for movement about a rear pivot axis.

10. The swing assembly of claim 1 wherein said swing members are each formed as a U-shaped member having a horizontal segment extending between said first and second side housing members and substantially vertical segments pivotally connected to said housing members.

11. The swing assembly of claim 1 wherein said second support means extends between said front and rear swing members in a front to rear direction.

12. The swing assembly of claim 1 wherein said seat member includes an upper edge extending above said housing members.

13. A swing assembly comprising:

housing means;

first support means mounted to said housing means for pivotal movement relative to said housing means;

second support means mounted to said first support means, wherein said first and second support means are pivotable relative to each other;

a seat member mounted to said second support means and defining means for receiving a person therein;

a pivot connection point between said seat member and said second support means, said seat member including positioning means adjacent to said pivot connection point for engaging said second support means to position said seat member in at least two predetermined angular positions relative to said second support means; and wherein said first and second support means cooperate to support said seat member for gliding movement relative to said housing means.

14. A swing assembly comprising:

a first housing member and a second housing member;

a front swing member and a rear swing member, said front swing member being mounted to said first and second housing members at front locations, said rear swing member being mounted to said first and second housing members at rear locations spaced from said front locations;

a front leg member and a rear leg member, said leg members being attached to and extending below said housing members for supporting said swing assembly on a floor surface; and a seat member supported by said front and rear swing members.

15. The swing assembly of claim 14 wherein said swing members are each formed as a U-shaped member having a horizontal segment extending between said first and second housing members and substantially vertical segments pivotally connected to said housing members.

16. The swing assembly of claim 14 wherein said seat member includes a support portion and first and second side portions on laterally opposite sides of said support portion, said assembly further including tray means having a horizontal tray member for extending between said side portions and post means rigidly attached to said tray member and engaging said support portion.

17. The swing assembly of claim 16 wherein said tray means is movable to first and second operable positions, said first operable position including engaging said tray member with said side portions and said tray means being movable in a linear vertical direction upwardly to said second operable position where said post member is pivotable relative to said seat member about a pivot point between said post means and said support portion.

18. The swing assembly of claim 14 including a drive mechanism located in one of said housing members for driving said seat member in a gliding swinging movement.

19. The swing assembly of claim 14 wherein said seat member includes an upper edge extending above said housing members.

20. A swing assembly comprising:

a first housing member and a second housing member;

a front swing member and a rear swing member, said swing members being mounted to said housing members;

a front leg member and a rear leg member, said leg members being attached to and extending below said housing members for supporting said swing assembly on a floor surface;

a seat member supported by said front and rear swing members; and support means intermediate said swing members and said seat member, said support means including a horizontal portion extending between said front and rear swing members and a vertical portion extending upwardly into engagement with said seat member.

21. The swing assembly of claim 20 wherein said seat member includes a support portion and first and second side portions on laterally opposite sides of said support portion, said vertical portion of said support means including first and second vertical members attached to said seat member at said side portions.

22. The swing assembly of claim 21 including pivot connections connecting said vertical members to said seat member and stop members angularly spaced from each other about said pivot connections for engaging said vertical members to thereby limit pivotal movement of said seat member.

23. The swing assembly of claim 22 including pivot connections between said front and rear swing members and said horizontal portion of said support means to accommodate relative pivotal movement between said swing members and said horizontal portion.

24. A swing assembly comprising:

housing means including first and second housing members located on laterally opposite sides of said swing assembly;

front and rear U-shaped leg members, each said leg member including a pair of vertical segments connected by a horizontal segment;

each said housing member including front and rear pivot connections for engaging said vertical segments of said front and rear leg members, respectively, such that said leg members are mounted for pivotal movement relative to said housing means;

first support means including front and rear U-shaped swing members, each said swing member including a pair of vertical segments connected by a horizontal segment, said vertical segments of said front swing member engaging said front pivot connections and said vertical segments of said rear swing member engaging said rear pivot connections, such that said front and rear swing members are mounted for pivotal movement relative to said housing means;

second support means including a horizontal portion and a vertical portion, said horizontal portion including first and second laterally spaced horizontal members extending between said front and rear swing members and said vertical portion including first and second vertical members formed as continuations of respective ones of said first and second horizontal members and extending upwardly from said horizontal members;

front and rear bearings mounted on said front and rear swing members and engaging said horizontal members of said second support means, said bearings accommodating relative pivotal movement between said second support means and said front and rear swing members;

a seat member including a support portion defined by a substantially horizontal seat portion and a substantially vertical back portion, and laterally opposed first and second side portions extending along said support portion;

first and second seat pivots located on said first and second side portions, respectively, for pivotally engaging an upper end of respective ones of said first and second vertical members whereby said seat member is mounted for pivotal movement relative to said second support means;

first and second stop surfaces located about said seat pivots and angularly spaced from each other, said stop surfaces extending laterally outwardly from said side portions for engaging said vertical members during pivotal movement of said seat member to define a sitting position and a reclining position for said seat member;

a tray means including a horizontal tray member and a vertical post member, said tray member including opposing engagement portions for engaging upper edges of said first and second side portions of said seat member, said post member being rigidly attached to a lower surface of said tray member and centrally located between said engagement portions;

means defining a post aperture in said seat portion for receiving said post member, said post aperture including side walls for slidably engaging said post member;

a pair of pin means located on said seat portion and extending laterally inwardly from opposing sides into said post aperture;

vertical grooves formed on opposing sides of said post member for receiving said pin means; and wherein said tray means is movable to first and second operable positions, said first operable position including positioning said post member with an upper portion of said vertical grooves engaging said pin means and said engaging portions of said tray member engaging said side portions of said seat member, said tray means being movable and guided by said side walls in a linear vertical direction upwardly to said second operable position where a lower portion of said vertical grooves engage said pin means and said post member is pivotable in a front to rear direction about said pin means.

25. The swing assembly of claim 24 including a cover member extending over said horizontal portion of said swing members and said horizontal portion of said second support means.

26. The swing assembly of claim 24 wherein said vertical segments of said front swing member are substantially the same length as said vertical segments of said rear swing member.

27. The swing assembly of claim 24 including a drive mechanism housed within one of said housing members and connected to said first support means to drive said seat member in forward and rearward gliding movement.

28. The swing assembly of claim 24 wherein said engagement portions on said tray member comprise tabs for cooperating with and extending into slots on said side portions of said seat member whereby said tray member is locked in position.

* * * * *